US006643955B2

(12) United States Patent
Pierce et al.

(10) Patent No.: US 6,643,955 B2
(45) **Date of Patent: *Nov. 11, 2003**

(54) RETENTION AND RELEASE MECHANISM FOR A SKI BOOT AND SKI BOOT INCORPORATING THE SAME

(75) Inventors: Javin Pierce, Stowe, VT (US); Andrea Fregoni, Paese (IT)

(73) Assignee: Lange International S.A. (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/867,214

(22) Filed: May 29, 2001

(65) Prior Publication Data

US 2002/0029497 A1 Mar. 14, 2002

Related U.S. Application Data

(63) Continuation-in-part of application No. 09/470,078, filed on Dec. 22, 1999, now Pat. No. 6,263,593, which is a continuation-in-part of application No. 09/091,390, filed on Jun. 19, 1998, now Pat. No. 6,131,313.

(51) Int. Cl.[7] ..... A43B 5/00
(52) U.S. Cl. ..... 36/118.3; 36/118.4
(58) Field of Search ..... 36/117.1, 118.3, 36/118.4, 118.7

(56) References Cited

U.S. PATENT DOCUMENTS

| | | | | |
|---|---|---|---|---|
| 4,349,971 A | * | 9/1982 | Everest, III | 36/118.7 |
| 4,501,078 A | | 2/1985 | Kopp | 36/121 |
| 4,519,150 A | | 5/1985 | Arieh et al. | 36/121 |
| 4,761,899 A | | 8/1988 | Marxer | 36/121 |
| 4,821,433 A | | 4/1989 | Marxer | 36/121 |
| 5,086,573 A | | 2/1992 | Mabboux et al. | 362/2.6 |
| 5,101,581 A | | 4/1992 | Hilgarth | 36/117 |
| 5,107,608 A | | 4/1992 | Kreitenberg | 36/117 |
| 5,127,171 A | | 7/1992 | Stampacchia | 36/120 |
| 5,136,794 A | | 8/1992 | Stampacchia et al. | 36/117 |
| 5,283,964 A | | 2/1994 | Chemello | 36/117 |
| 5,560,128 A | * | 10/1996 | Marega et al. | 36/118.2 |
| 5,590,481 A | | 1/1997 | Vaccari | 36/118.8 |
| 6,131,313 A | * | 10/2000 | Pierce et al. | 36/118.3 |
| 6,263,593 B1 | * | 7/2001 | Pierce et al. | 36/118.3 |

FOREIGN PATENT DOCUMENTS

| | | | |
|---|---|---|---|
| EP | 375604 | 11/1989 | A43B/5/04 |
| EP | 514762 | 5/1992 | A43C/11/00 |
| FR | 2647649 | 5/1990 | A43B/5/04 |
| WO | 92/05718 | 4/1992 | A43B/5/04 |

* cited by examiner

*Primary Examiner*—M. D. Patterson
(74) *Attorney, Agent, or Firm*—Grossman, Tucker, Perreault & Pfleger, PLLC

(57) ABSTRACT

A retention and release mechanism and ski boot for mitigating injury to a skier when the rearward loads, potentially injurious to the user, are imparted to the boot. The mechanism includes a first linkage having an end coupled to a first rigid boot portion, and a second linkage coupled to the first linkage through a pin disposed in a slot in the first linkage. The mechanism provides stable orientation of the first portion to the second portion in a "ski" position, and allows rotation of the first portion relative to the second portion in a "release" position, the "release" position being established upon imposition of a predetermined level of rearward force on the boot.

11 Claims, 13 Drawing Sheets

RETENTION AND RELEASE MECHANISM FOR A SKI BOOT AND SKI BOOT INCORPORATING THE SAME

CROSS REFERENCE TO RELATED APPLICATIONS

The present application is a continuation-in-part application of co-pending U.S application Ser. No. 09/470,078, filed Dec. 22, 1999, now U.S. Pat. No. 6,263,593 which is a continuation-in-part of U.S. application Ser. No. 09/091,390, filed on Jun. 19, 1998, now U.S. Pat. No. 6,131,313, the teachings of which applications are incorporated herein by reference.

FIELD OF THE INVENTION

The present invention relates to a retention and release mechanism for ski boots, and, more particularly, relates to a mechanism and ski boot construction which allows for a safe and biomechanically natural rearward articulation of a user's foot for thereby substantially reducing the risk of severe injury.

BACKGROUND OF THE INVENTION

There is an inherent and known risk of injury associated with the sport of downhill skiing. A significant source of injury is the rigid association between a user and prior art skis and ski boots. In view of this, various prior art devices have been proposed for reducing the risk of injury in the sport of downhill skiing. The vast majority of these disclosures relate to improvements in the ski binding, i.e. the mechanism affixed directly to the ski for receiving the ski boot.

In addition, there have been attempts to modify the ski boot itself. Generally, however, ski boot modifications have been directed to providing a mechanism for the wearer to more readily step into and out of the boot. For example, in U.S. Pat. No. 5,136,794 there is reported a ski boot consisting of a lower part and of a shaft, in the form of a collar, which is articulated on the lower part and provided with at least one closing buckle. The shaft includes, at the rear, a rocker that interacts with a stop that is integral with the lower part in order to lock the shaft in a position inclined forwards. The rocker is held in inactive position upon opening of the uppermost buckle by means of a cable and a spring. Thus, the shaft is not inadvertently locked during walking.

Attention is also directed to U.S. Pat. No. 5,127,171 and art cited therein, which reports a ski boot with a shell having a shaft in two parts, the rear part of which is connected, on the one hand, to the shell and, on the other hand, to the front part of the shaft by two pair of links. The axes of articulation on the rear part are situated, in the closed position of the boot, on the sides of the plane containing the axes of articulation on the shaft and the front part of the shaft. It is possible to open the shaft wide for putting the boot on, while having only a limited rearward tilting of the rear part. The upper connection can be associated with a closing lever.

In U.S. Pat. No. 5,107,608, there is reported a ski boot for reducing the incidence of knee injuries wherein the boot is said to exert a forward directional force on the skier's leg. A releasing means changes the rigid support position for the foot and the lower leg on application of a predetermined level of force by the boot on the wearer. The '608 patent further reports that rearward pressure of the person's lower leg against the rear leg element of the boot can be sensed by force sensors producing electrical outputs by the use of piezoelectric material. In addition, as illustrated in FIG. 7 therein, a mechanical latch assembly employing a tension spring is disclosed. The tension spring is described as urging or maintaining the device in ski position, and, when spring force is overcome, a release position is obtained as shown in FIG. 8.

U.S. Pat. No. 5,283,964 discloses a boot device for front-to-back immobilization of the upper, which acts on an oscillating level capable of being supported against a stop on the shell base. The device is constituted by a rectilinear motion control mechanism. The mechanism includes an external control device having an inner part which actuates, via a cam, a sensing device associated with the oscillating lever, thereby imparting to the latter an angular rotating movement around its pin toward a locked or release position in relation to the stop formed on the shell base.

Attention is also directed to following foreign patent documents: WO 92/05718 and 0514762A2. More specifically, in WO 92/05718 there is disclosed a ski boot for enhancing the safety of skiing. Finally, reference is made to EP-375–604-A, which discloses a ski boot with a stop holding the leg forward, and French Patent 2647-649-A, which discloses a ski boot with an articulated leg locked in a forward position. The leg has a clip at the back that pivots around the horizontal axis.

All of the above, however, are distinct from the present invention, in that they collectively fail to provide, in the boot itself, a practical and effective mechanism for mitigation of knee injuries while used in skiing. There is, therefore, a long-felt need in the art for a ski boot retention and release mechanism that specifically reduces potentially injurious forces to the anterior cruciate knee ligament (ACL).

Accordingly, it is an object of the invention to provide a ski boot design that restricts the rearward movement of the rigid upper of a ski boot by allowing rearward travel of the same after a selected level or predetermined threshold of force has been obtained.

Another object of the invention is to provide a ski boot design having a mechanism to affect upper displacement when appropriate to create a safer environment and enhanced safety to the user.

Yet another object of the invention is to provide a ski boot design having a retention and release mechanism to for improving safety.

Another object of the invention is to provide a ski boot that allows the potentially damaging rearward forces at the upper section of a ski boot to be absorbed or transduced.

A further object of the invention is to provide a ski boot design which prevents or mitigates the severity of injuries to the anterior cruciate knee ligament and to provide a more safe natural biomechanical rearward articulation in the boot for the user thereof.

A further object of the invention is to provide a ski boot with a walk position combined with a release mechanism to improve safety.

Yet a further object of the present invention to provide ski boot design which prevents or mitigates the severity of injuries to the anterior cruciate knee ligament that can be cost-effectively mass produced.

These and other objects of the present invention will become apparent from a review of the description provided below.

SUMMARY OF THE INVENTION

The present invention is organized about the concept of providing a ski boot having a retention and release mechanism for mitigating injury to the skier's anterior cruciate knee ligament when the skier exerts rearward loads, potentially injurious to the knee, to the boot shaft upper. The mechanism extends between the lower portion of the ski boot and the upper portion of the boot, which is pivotable with respect to the lower portion. In a "ski" position, the mechanism maintains stable orientation between the upper and lower portions of the boot. Upon imposition of a predetermined level of rearward force, i.e. in the event of a rearward fall, the mechanism moves to a "release" position wherein rearward rotation of the upper relative to the lower portion is allowed to reduce the risk of injury.

Recovery from the "release" position to the "ski" position is possible via user stance adjustment in the boot to impart a forward force on the upper. In the event that such a stance adjustment cannot be immediately achieved, the mechanism reduces the moment arm of the ski with respect to the skiers' center of gravity thereby reducing forces to the knee while still providing support of the leg and thereby permitting the skier to continue skiing until recovery or falling. In the case of falling, rearward contact with the snow over the ski tail requires less derangement and force loading of the knee joint. The mechanism is releasable from the ski boot to allow free rotation of the upper relative to the lower in a "walk" position to facilitate a relatively natural walking motion.

More particularly, a ski boot consistent with the invention includes: a rigid first boot portion pivotally coupled to a rigid second boot portion, and a release and retention mechanism consistent with the invention. The mechanism includes a first linkage having an end coupled to the first boot portion, and a second linkage coupled to the first linkage through a pin disposed in a slot in the first linkage. The mechanism changes the first boot portion from a ski position relative to the second boot portion to a substantially vertical release position upon travel of the pin in the slot due to application of a predetermined rearward force to the first boot portion.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION

Figure 1:
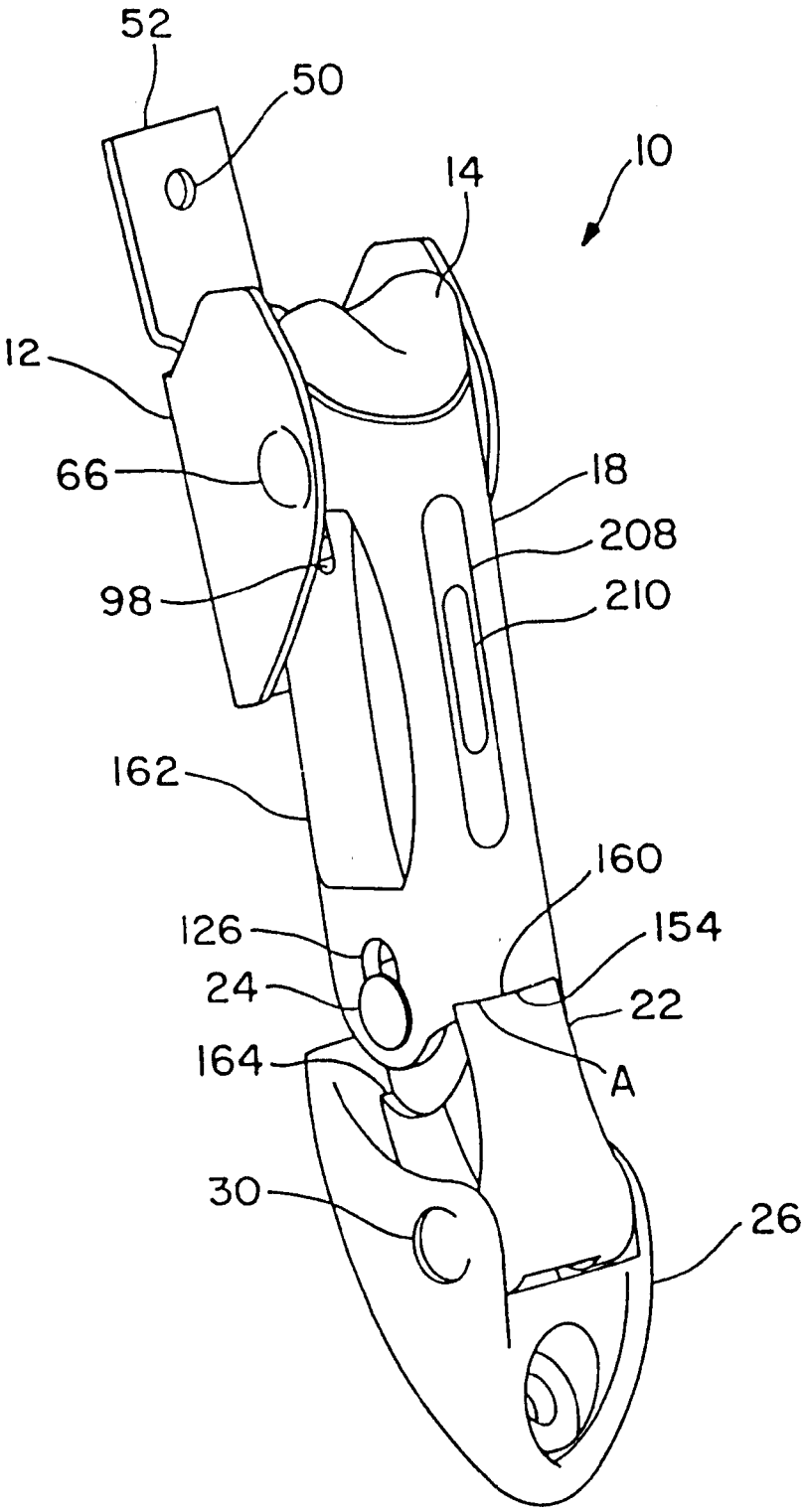
FIG. 1: is a perspective view of an exemplary retention and release mechanism consistent with the present invention.
Figure 2:
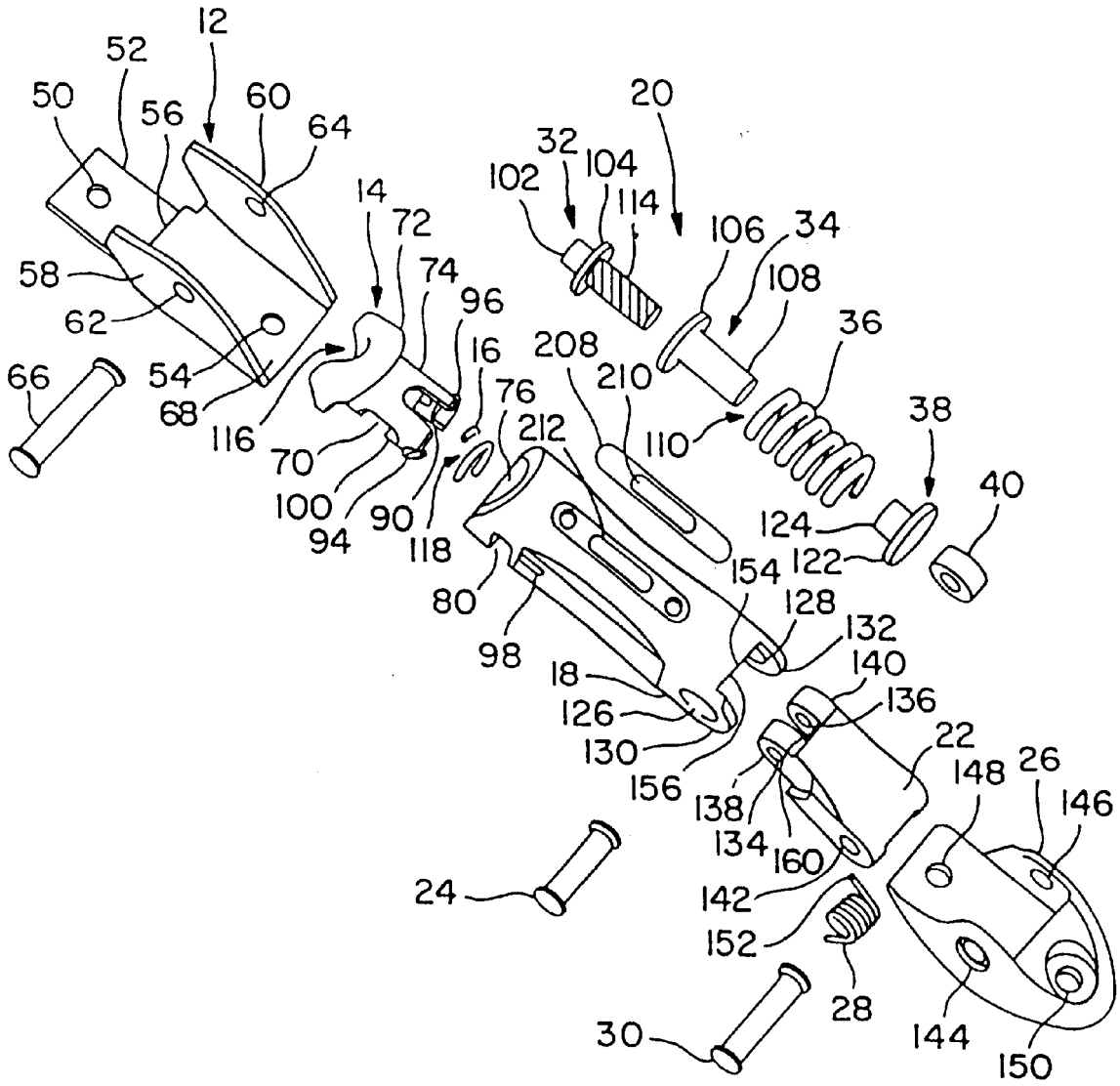
FIG. 2: is an exploded view of the retention and release mechanism illustrated in FIG. 1.

With reference now to FIGS. 1 and 2, there is shown an exemplary embodiment of a retention and release mechanism 10 consistent with the invention. As shown, the mechanism generally includes a plate 12, a release latch 14 disposed over a compression spring 16, an upper arm linkage 18 housing a tension adjustment assembly 20, a lower arm linkage 22 having a first end pivotably attached to an end of the upper arm linkage by a pivot pin 24 and a second end pivotably attached to a mounting bracket 26 by a pivot pin 30, and a torsion spring 28 for creating a bias force tending to rotate the lower arm linkage 22 in an inward direction, i.e., toward a ski boot as shown, for example, in FIG. 5. The tension adjustment assembly 20 generally includes a threaded release tension adjustment screw 32, a corresponding tension adjustment nut 34, a tension spring 36, a retainer pin 38 and a stop 40.

The plate 12 is adapted to be affixed to a ski boot. Those skilled in the art will recognize that there are a variety of means by which the plate 12 may be affixed to the boot. In the illustrated exemplary embodiment, however, the plate includes a first bore 50 on a tab 52 and a second bore 54 at an opposite end of the plate. The tab 52 may be bent at a 90 degree angle relative to the plate, e.g. at line 56, and inserted into an opening (not shown) in the upper of the ski boot. The tab may be further bent to position the end of the tab and the bore 50 against the interior surface of the upper. Fasteners (not shown) may be passed through the bores 50,54 and into the boot to couple the plate 12 thereto.

The plate also includes a pair of spaced, opposed tabs 58,60 extending outward at a 90 degree angle from the back surface 68 of the plate. The tabs 58, 60 include aligned lock pin bores 62, 64 therein for receiving opposite ends of a lock pin 66. As will be described in detail below, the lock pin is dimensioned to be removably received within corresponding transverse slots 70, 80 in the release latch 14 and upper arm linkage 18, respectively.

Figure 3:
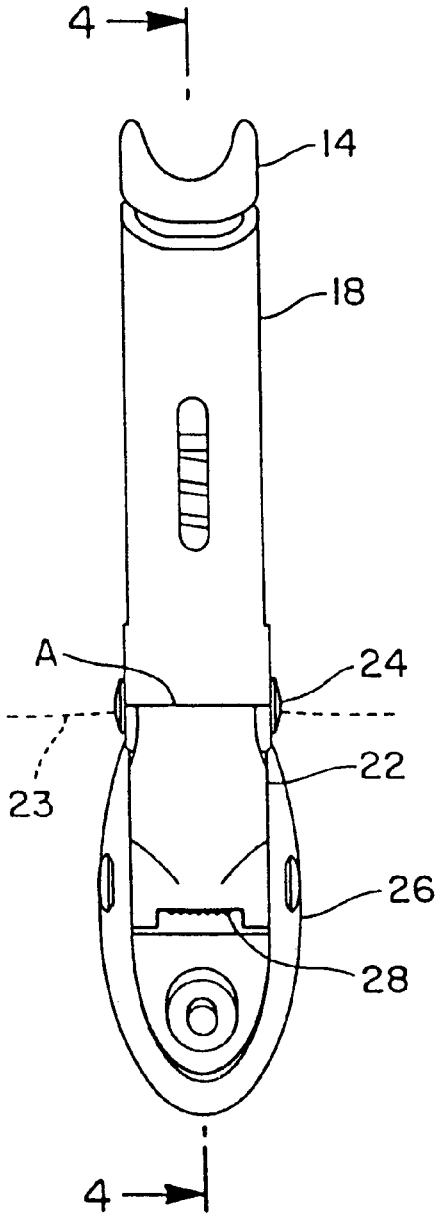
FIG. 3: is a front view of the retention and release mechanism illustrated in FIG. 1.
Figure 4:
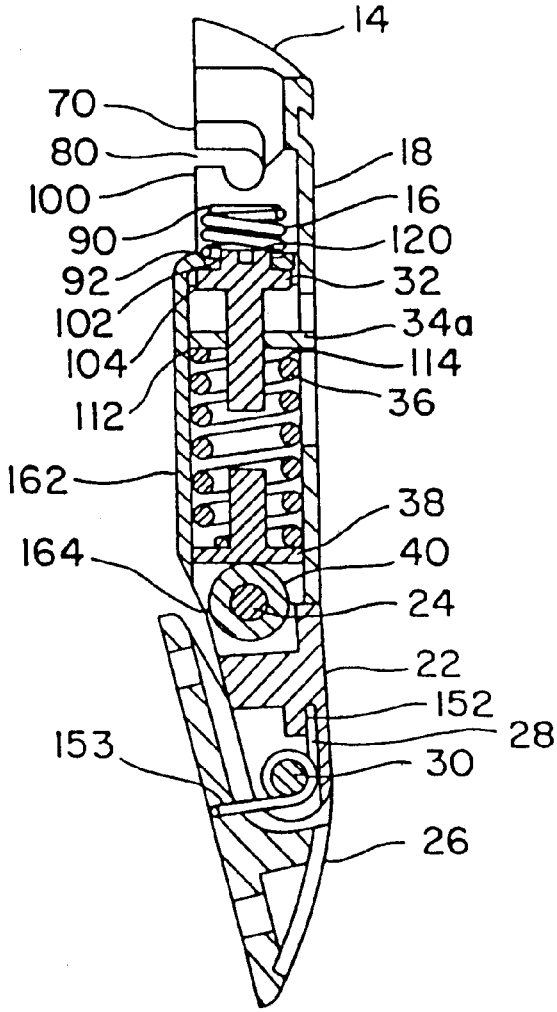
FIG. 4: is a sectional view of taken along lines 4—4 in FIG. 3.

The release latch 14 has a head portion 72 and a shaft portion 74. With reference also to FIGS. 3 and 4, the end of the shaft portion distal from the head is received within central opening 76 in the upper arm linkage 18. As shown particularly in FIG. 4, the compression spring 16 is positioned between a shelf 90 on the interior of the latch and an opposing shelf 92 on the interior of the upper arm linkage 18. A pair of tabs 94, 96 extend radially outward from the latch and into corresponding aligned slots, e.g. slot 98 formed in the sides of the upper arm linkage. The release latch is thereby captured within the upper arm linkage and biased outward from the linkage by the compression spring 16.

Axial travel of the latch within the opening in the linkage arm 18 is limited by engagement of the tabs 94, 96 with the ends of the slots, e.g. slot 98. In an at rest position, the compression spring biases the tabs against the upper ends of the slots, and the transverse slot 70 in the latch extends into the opening in the upper linkage arm defined by the slot 80 therein, as shown, for example, in FIG. 7. In this position, the lock pin may be captured in the slots 70, 80 by a lip 100 on the latch. The latch may, however, be depressed against the force of the spring 16 until the tabs contact the bottoms of the slots, and until the slot 70 aligns with the slot 80 to permit entry or exit of the lock pin 66 into the slots 70, 80.

The upper arm linkage 18 provides a housing for the tension adjustment assembly 20. With continued reference to FIG. 4, the adjustment screw 32 has a head portion 102, which extends through a bore in the shelf 92. The head is disposed within the bore with a radially extending flange 104 positioned against a bottom surface of the shelf 92. The head is disposed within the bore to prevent axial movement of the screw 32, while allowing rotation of the screw.

FIGS. 2 and 4 show alternative exemplary embodiments, i.e. 34, 34*a*, respectively, of the adjustment nut. The nut 34 in FIG. 2 includes a head portion 106 that rests on a top of the compression spring 36 and a shaft portion 108, which is adapted for extending into a central opening 110 of the compression spring. The nut 34*a*, as shown in FIG. 44, has a simple flat construction. A bottom surface 112 of the nut 34*a* rests on the top of the compression spring.

In any embodiment, however, the nut includes a threaded bore for meshingly engaging the threads on a shaft 114 adjustment screw. The head 102 of the screw is exposed at the top surface of the shelf 92 to permit access to the head by a tool (not shown) extending through the opening 116 in the latch from the top thereof and through the central opening 118 of the spring 16. The head is adapted to receive the tool so that the tool may be manipulated to rotate the head of the screw. For example, in the illustrated exemplary embodiment, the head includes a transverse slot 120 therein for receiving the end of a standard screwdriver. The end of the screwdriver may be passed through the top of the latch 14 and through the spring 16 to engage the slot 120.

Rotation of the screw by the tool causes translation of the adjustment nut 34, 34*a* on the shaft 114 of the screw. The tension spring 36 is trapped between the bottom surface 112 of the nut 34*a* (or the bottom of the flange of the nut 34 in FIG. 2) and the flange 122 on the retainer pin 38. The retainer pin is fixed within the upper linkage arm 18 with a bottom surface the flange 122 disposed against the annular stop 40, which is fixed around the pivot pin 24. In the illustrated embodiment, the retainer pin includes a shaft portion 124 that extends into the central opening 110 of the spring to stabilize the spring and the pin within the upper linkage arm. As will be described in more detail below, with the spring trapped between the nut 34*a* and the pin 38, translation of the nut caused by rotation of the screw results in corresponding compression/relaxation of the compression spring depending on the direction of rotation.

The upper linkage arm is pivotably coupled to the lower linkage arm 22 by the pivot pin 24 extending through slots 126, 128 in clevis plates 130, 132 formed on the upper linkage arm and corresponding bores 134, 136 in devises 138, 140 formed on the lower linkage arm. The slots permit limited axial movement of the upper linkage arm relative to the lower linkage arm to facilitate pivotal movement of the upper arm relative to the lower arm. The lower linkage arm includes a transverse bore 142 in the bottom portion thereof. The arm is pivotally coupled to the mounting bracket 26 by the pivot pin 30 extending through the bore and corresponding aligned bores 144, 146 in the mounting bracket 26. Bores 148, 150 in the mounting bracket are provided to facilitate affixation of the bracket 26 to the ski boot by fasteners, e.g. screws, extending through the bores and into the boot.

The torsion spring 28 is positioned around the pivot pin 30 and has a first end 152 captured by the lower linkage arm and a second end 153 captured by the mounting bracket. The spring thereby biases the linkage arm for rotation about the pivot pin in a direction toward the boot. In this non-release position, as shown for example in FIGS. 1, 3 and 4, the bottom edge 156 of the upper linkage arm is positioned adjacent the upper edge 160 of the lower linkage arm at a point which is offset from the axis of the pin 24.

Figure 6:
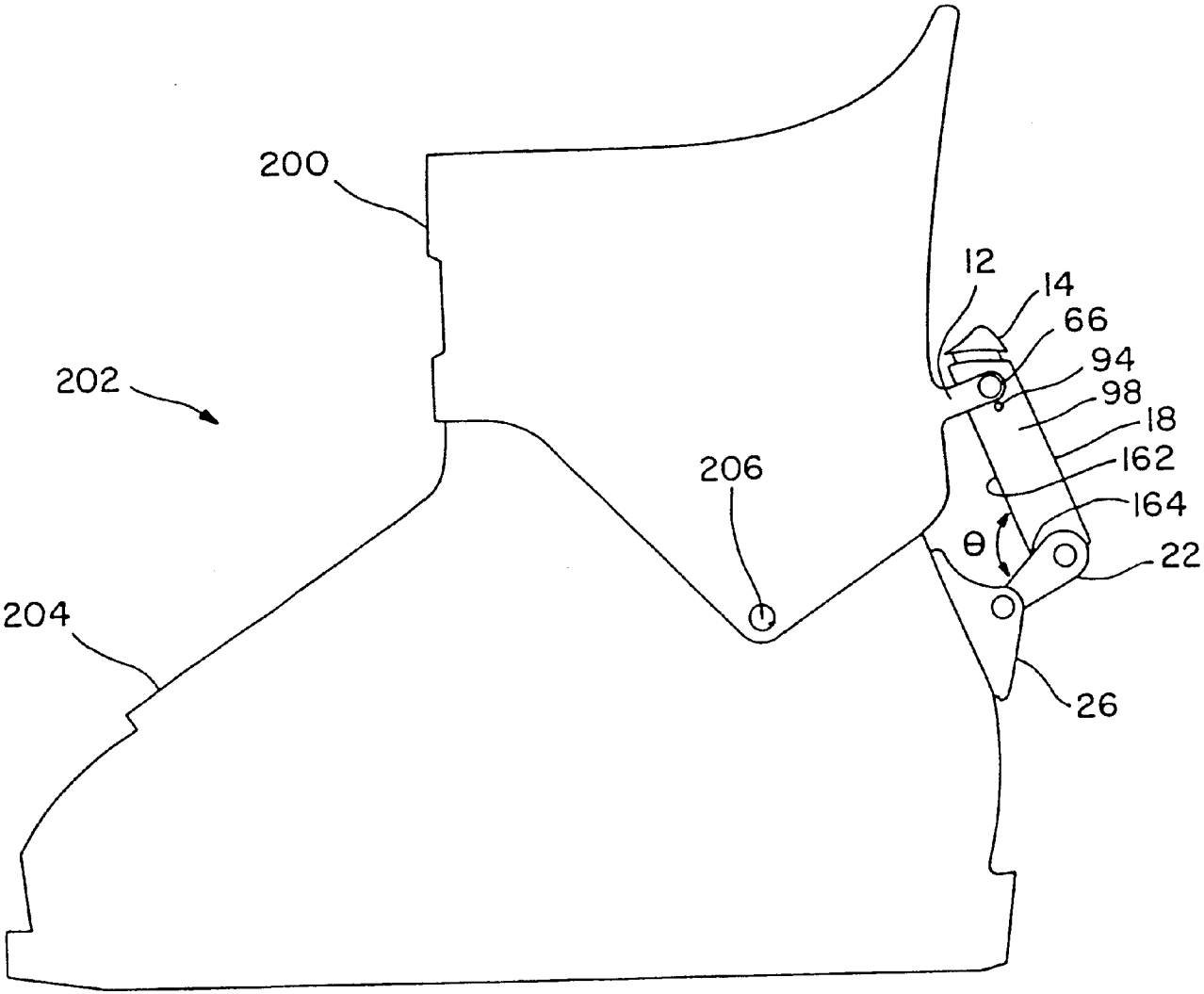
FIG. 6: illustrates an exemplary retention and release mechanism and ski boot consistent with the invention with the mechanism in a "released" position.

In a release position rotation (i.e., in a direction toward the boot) of the upper arm 18 relative to the lower arm 22 is limited by contact of the rear surface 162 of the upper arm against the contact points, e.g. point 164, on both sides of the lower linkage arm, as shown, for example, in FIG. 6. This limit may also be obtained by interference of the boot upper with the lower portion, or by means of a dash pot or stop(s) that coacts with the one or more parts of the retention and release mechanism or another portion of the boot upper. In any event, the secondary "stop" or arrest mechanism should limit rearward travel of the upper to less than approximately 20 degrees rearward from vertical.

Figure 5:
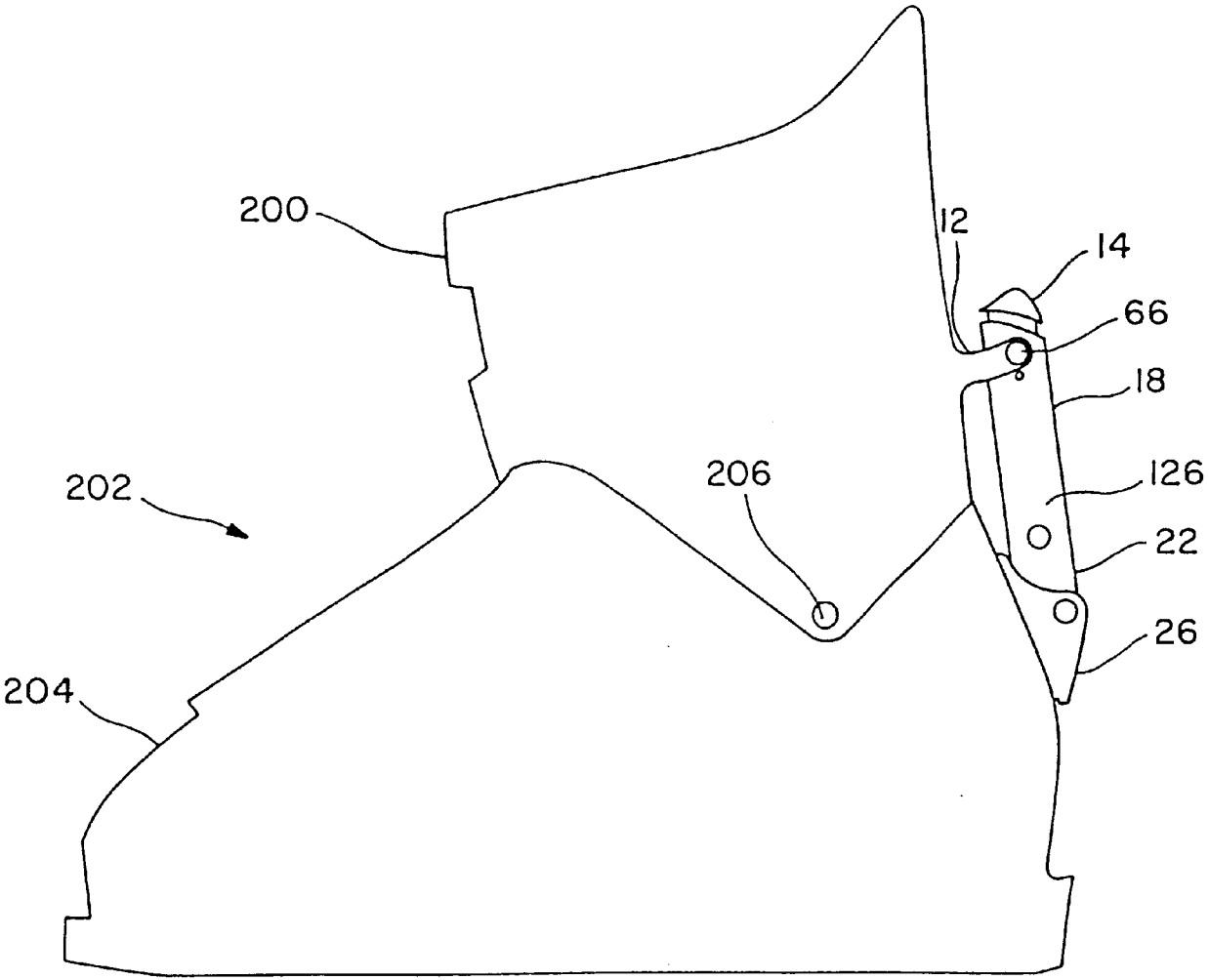
FIG. 5: illustrates an exemplary retention and release mechanism and ski boot consistent with the invention with the mechanism in a "ski" position.
Figure 7:
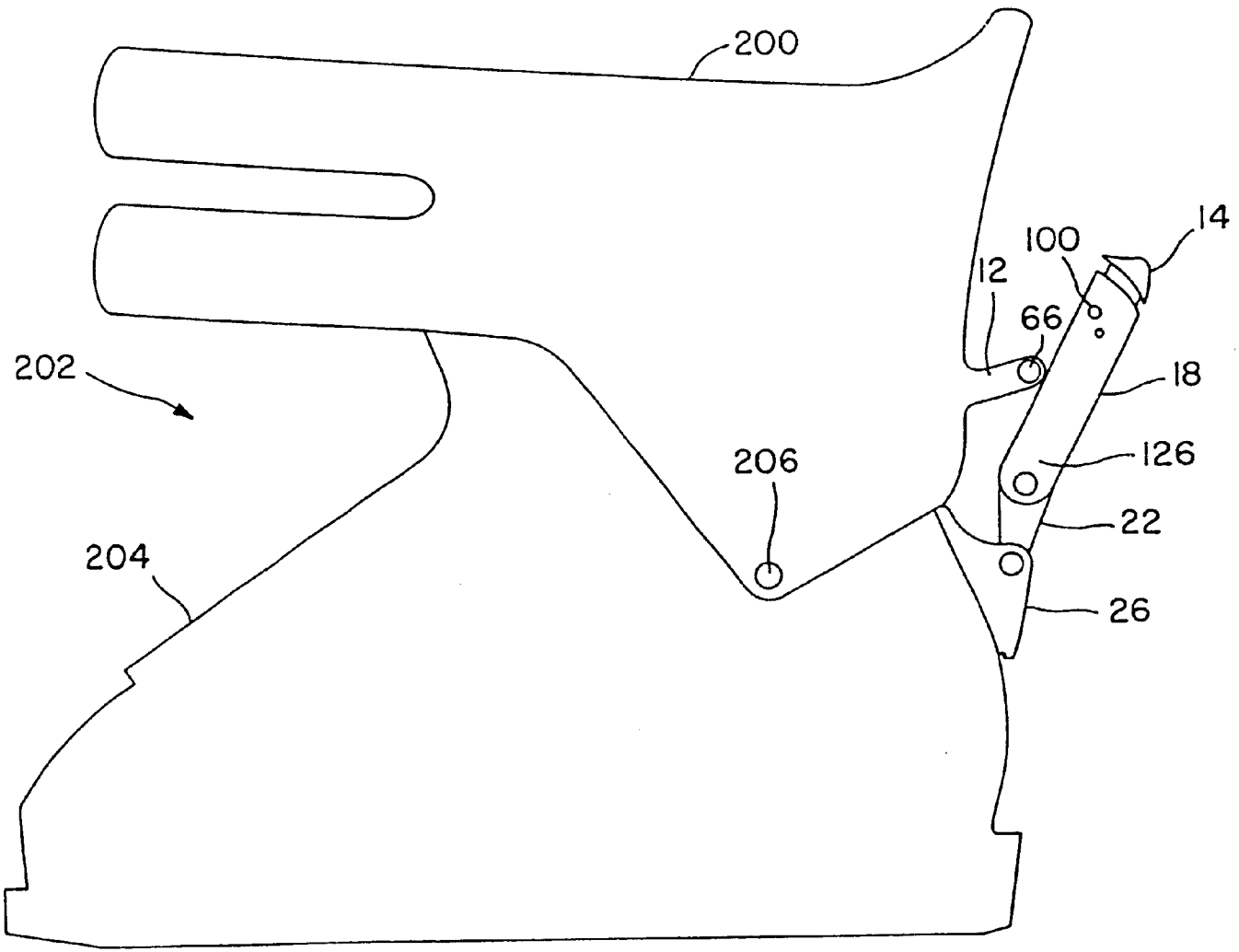
FIG. 7: illustrates an exemplary retention and release mechanism and ski boot consistent with the invention with the mechanism in a "walk" position.

The operation of an exemplary release and retention mechanism consistent with the invention, along with additional structural features, will now be described. With reference also to FIGS. 5–7, the plate 12 is secured to the rigid upper 200 of the ski boot 202, while the mounting bracket 26 is secured to the lower portion 204 of the boot. In the "ski" position, as shown in FIG. 5, the locking pin 66 is disposed within the slot 70 in the latch and the slot 80 of the upper linkage arm. The lip 100 on the latch extends upward at the front of the slot 70. The compression spring 16 biases the latch against the locking pin 66 and the lip prevents removal of the pin 66 from the slots 70,80 absent depression of the latch 14 by a user.

Figure 8A:
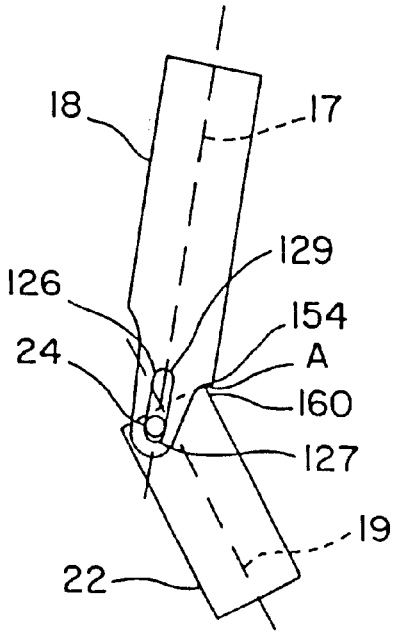
FIGS. 8A–8C: illustrate successive positions of upper and lower arm linkages of an exemplary retention and release mechanism consistent with the invention as the linkages travel from a "ski" position to a "release" position.

With the mechanism in "ski" position, the lower linkage arm 22 is biased toward the boot 202 by the torsion spring 28. With reference also to FIG. 8A, the tension spring 36 biases the upper linkage arm against pivot pin 24 into the bottom 127 of the slot 126–128. In this position, the axes 17, 19 of the two linkages are not aligned, and the linkages contact the contact point A between the end 156 and the edge 160. The engagement of the locking pin 66 with the release mechanism provides a rigid structure that resists rearward rotation of the upper 200 relative to the lower portion 204 of the boot about the pivot point 206.

The level of resistance before releasing against rearward rotation of the upper 202 is adjustable through the tension adjustment assembly 20 to provide a suitable level of resistance for a particular user, e.g. depending on the user's physical characteristics and skiing style. A tool may be passed through the top of the latch to rotate the adjustment screw, as described above. In one direction of rotation, the rotation of the screw causes axial motion of the nut 34*a* tending to compress the spring 36 and increase the resistance to rearward rotation by increasing the force against the lower linkage arm 22 through the pivot pin 24. In an opposite direction of rotation, the nut translates in an opposite direction to relax the spring 36 and decrease the resistance to rearward rotation of the upper 202.

The level of releasing resistance established by the tension adjustment assembly may be indicated on a visual tension indicator 208. As shown, for example, in FIG. 2, the indicator may mount on a front of the upper linkage arm, and may have a slot 210 that aligns with a corresponding slot 212 in the linkage arm. The position of the top of the adjustment nut, e.g. nut 34, may be observed through the slots 210 and compared against a scale (not shown) provided on the face of the tension indicator 208. An appropriate level of resistance/tension based on the scale may be recommended for a particular user.

With the mechanism in the "ski" position, as shown in FIG. 5, a user may ski normally with the upper and the lower portion of the boot in a stable relationship to each other and the user. In the event of a rearward fall, however, the user would lean back in the boots, generating a rearward rotational force on the upper relative to the pivot point 206. Advantageously, this force would transfer to the mechanism 10 and would overcome the resistance provided by the tension adjustment assembly 20 and the bias force of the torsion spring. During the rearward rotation of the upper 202, the force F causes downward travel of the upper linkage arm 18 in a direction of force F with the pivot pin 24 traveling toward the top 129 of the slots 126–128. During travel, the two linkages rotate in a direction away from the boot around the point of contact A between the end 154 and the edge 160.

Figure 8B:
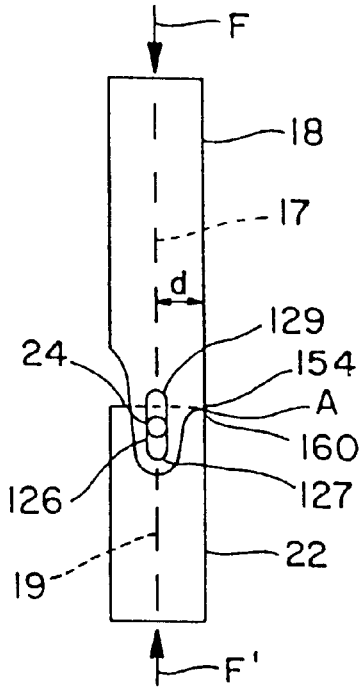
Figure 8C:
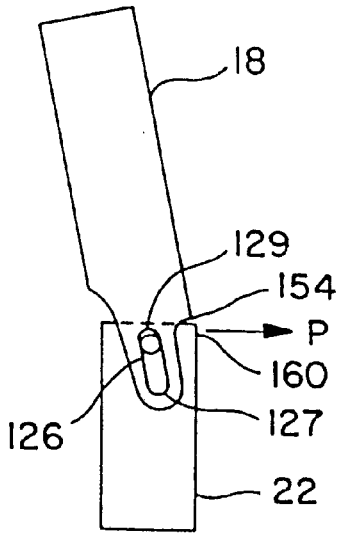

At the predetermined level set by appropriate adjustment of the tension spring, as illustrated in FIG. 8B, the axes 17, 19 of the two linkages are aligned and the end 156 and the upper edge 160 contact at point A, which is offset by a distance d from the axis 23 (FIG. 3) of the pivot pin 24. At this point, with only an incremental increase in the force F, the upper linkage 18 travels downwardly, and, due to the offset point of contact A from axis 23, creates a component P of force which urges the mechanism to open toward the release position, as illustrated in FIG. 8C.

Figure 9:
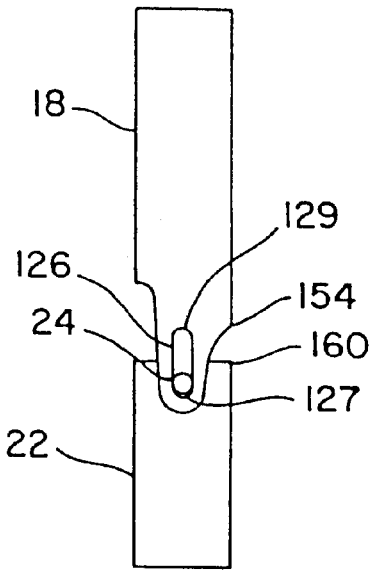
FIG. 9: illustrates a "ski" position for another exemplary embodiment of a retention and release mechanism consistent with the invention.

In another exemplary embodiment of the invention, the two linkages may be already aligned in the rest position, as illustrated in FIG. 9. In this embodiment, the two linkages are not in contact from the beginning. During rearward rotation of the upper 202, the upper linkage arm travels downwardly. At the predetermined level of force, the two linkage arms come in contact at the point A, as illustrated in FIG. 8B, and then open toward a release position as shown, for example, in FIG. 8C.

The release and retention mechanism thus moves to the "release" position, in which the upper may be substantially vertically disposed, as shown, for example, in FIG. 6. The rearrangement of the upper and lower arm linkages in this manner allows the upper to rotate rearward until travel is arrested by contact of the rear surface of the upper link arm 162 against the contact points 164 of the lower link arm. This arrest may occur, for example, when the angle θ between the upper and lower linkage arms reaches approximately 90 degrees to correspond to rotation of the upper of approximately 20 degrees rearward from the vertical "ski" position. When the skier recovers from the fall and is able to rotate the upper forward again, the upper and lower arm linkages will rearrange into the stable "ski" position with the assistance of the torsion spring 28.

Another advantageous feature of a retention and release mechanism consistent with the invention is illustrated in FIG. 7, wherein the mechanism is illustrated in "walk" position. It is well known that normal walking motion is severely restricted by prior art boot designs wherein the upper 200 is rigidly fixed relative to the lower portion 204 of the boot. According to the present invention, however, a user may release the latch 14 from the locking pin 66 by depressing the latch and rotating the mechanism rearward away from the locking pin. In this "walk" position, the retention and release mechanism is disconnected from the upper, thereby allowing rearward rotation of the upper during walking to allow a more natural waking motion. In the "walk" position, the torsion spring 28 biases the mechanism toward the boot to prevent undesired motion of the mechanism relative to the boot, and the lip 100 prevents inadvertent engagement of the latch with the pin 66. When the user desires to continue skiing, the mechanism may be returned to the "ski" position simply by depressing the latch 14 to allow entry of the locking pin into the slots 70, 80, and then releasing the latch to capture the locking pin.

Figure 10:
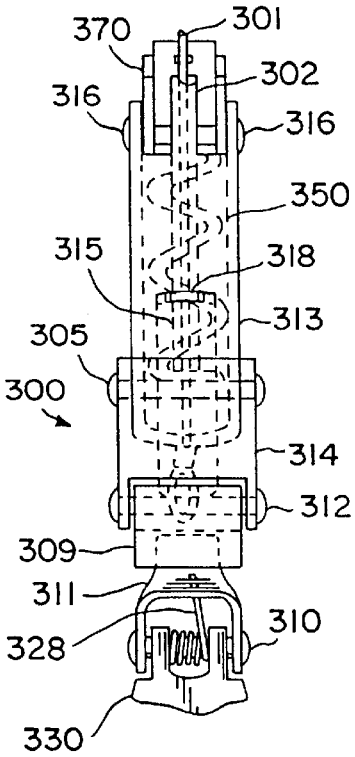
FIG. 10: illustrates a front view of another exemplary embodiment of a retention and release mechanism consistent with the present invention in a "ski" position.
Figure 11:
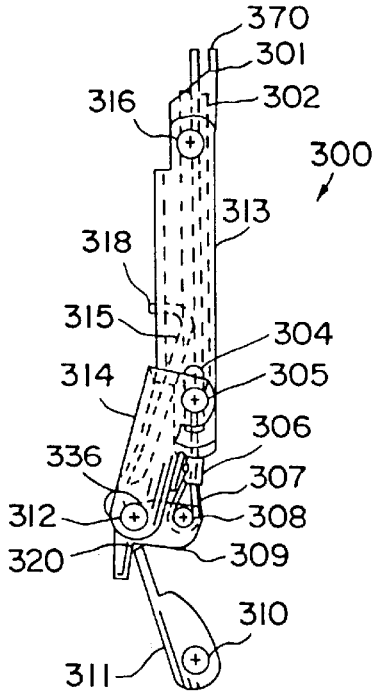
FIG. 11: illustrates a side view of the embodiment of FIG. 10 in a "ski" position.
Figure 12:
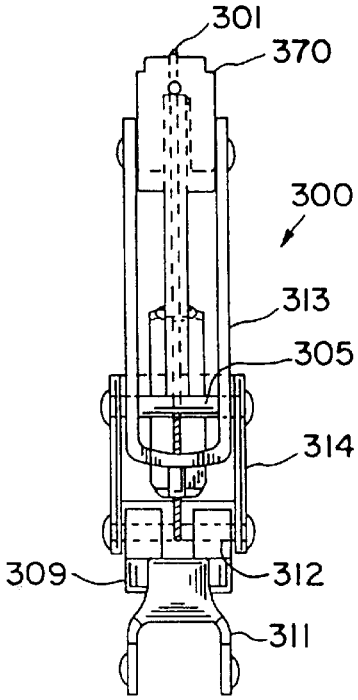
FIG. 12: illustrates a back view of the exemplary embodiment of FIG. 10 in the "ski" position.
Figure 13:
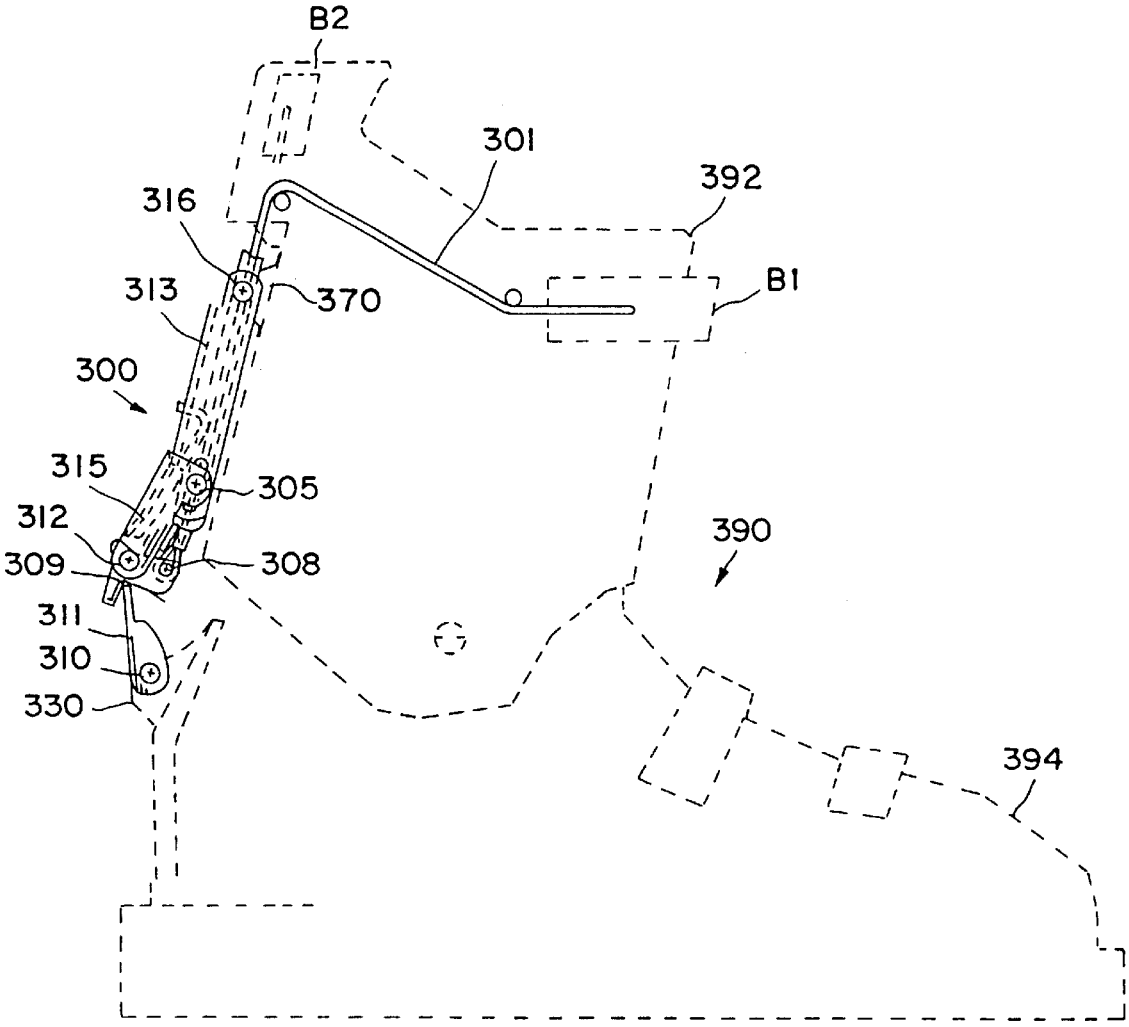
FIG. 13: illustrates the exemplary embodiment of FIG. 10 coupled to a ski boot in the "ski" position.

With reference now to FIGS. 10–13, there is shown another exemplary embodiment 300 of a retention and release mechanism consistent with the present invention. FIGS. 10, 11 and 12 show the mechanism 300 in a "ski" position from the front, side and rear respectively. FIG. 13 shows the mechanism 300 coupled to a ski boot 390 in the "ski" position.

As shown, the mechanism generally includes an upper arm linkage 313, a lower arm linkage 314, a dislodging cam element 315, a cam member 309, and an articulating stop 311. The upper arm linkage 313 and the lower arm linkage 314 each have a first end and a second end. The first end of the upper arm linkage 313 is pivotally coupled to a plate 370 by a pivot pin 316. The plate 370 is attached to an upper portion 392 of the ski boot 390 using conventional methods.

The second end of the upper arm linkage 313 is pivotally coupled to the first end of the lower arm linkage 314 by a pivot pin 305 that extends through a bore in the lower arm linkage and a slot 304 in the upper arm linkage. The upper arm linkage 313 houses a compression spring 350 disposed between pivot pin 316 and pivot pin 305. In the "ski" position shown in FIG. 10, the compression spring 350 urges pivot pin 305 and the lower arm linkage 314 towards the bottom of the slot 304, i.e., away from the pin 316.

The second end of the lower arm linkage 314 is pivotally coupled to the cam member 309 by a pivot pin 312. The cam member 309 has a receiving notch 320 for engaging the articulating stop 311. Cam member 309 further includes a dislodging cam receiving notch 336. A first end of the dislodging cam element 315 may be positioned to adjacent cam receiving notch 336 for engaging the notch 336 to release the mechanism, as described in greater detail below. A second end of the dislodging cam element is disposed in a cam element receiving notch 318 in the upper arm linkage 313.

The articulating stop 311 is pivotally coupled to a plate 330 by a pivot pin 310. As shown in FIG. 13, the plate 330 may be attached to a lower portion 394 of the ski boot using conventional methods. A torsion spring 328 supported by the pivot pin 310 has an end fixed to the stop 311 to create a biasing force tending to rotate the articulating stop 311 in a counterclockwise direction as viewed in FIG. 11, i.e., away from the boot.

The retention and release mechanism 300 further comprises a cable 301, a cable housing 302, and a cable-clamping ferrule 306. The cable clamping ferrule 306 forming a loop 307 on a first end of the cable 301. The loop 307 may be secured to the cam member 309 via the pin 308.

The cable 301 and cable housing 302 extend towards the upper portion 392 of the ski boot 390. The second end of the cable 301 may be secured to a buckle located on the upper portion 392 of the ski boot 390, as shown in FIG. 13. The buckle may be an existing buckle B1 i.e. one used to secure the ski boot 390 to the leg of the skier, or a dedicated buckle B2 i.e. used only to apply tension to the cable 301.

In operation, closure of the buckle creates tension in the cable 301. This urges the cam member 309, and the articulating stop 311 by virtue its engagement with notch 320, to rotate in a counterclockwise direction to place the mechanism 300 in the "ski" position, as shown. The compression spring establishes a bias force that maintains the mechanism in the "ski" position with the pin 305 disposed near the bottom of the slot 304. In the embodiment shown, the mechanism forms a substantially stable assembly for providing stable orientation of the upper portion 392 of the ski boot 390 to the lower portion 394 of the ski boot 390.

When the upper portion 392 of the ski boot 390 is forced rearward by the skier's leg, a downward force is exerted on upper arm linkage. When this force is sufficient to overcome the bias of the compression spring, the upper arm linkage 313 begins to travel downward. The pin 305 thus travels in slot 304 from the bottom of the slot 304 toward to the top of the slot 304. If the downward force is above a predetermined level established by appropriate selection of the compression spring, the downward movement of the upper arm linkage 313 urges dislodging cam element 315 to abut the cam member 309 at the dislodging cam-receiving notch 336.

Engagement of the dislodging cam element 315 with cam member 309 causes the creation of a force on the first linkage element 313 at point 318. This force urges the first element 313 to rotate clockwise and then to open the mechanism. In this "release" position, the upper portion 392 of the ski boot 390 is allowed to rotate rearward relative to the lower portion 394 of the ski boot 390 to achieve a substantially vertical orientation. By allowing the ski boot to enter the "release" position, the skier has a reduced risk of injury to his leg, especially the knee. The skier can reset the mechanism to a "ski" position by exerting force on the upper portion in a forward direction.

The skier can manually enter a "walk" position by simply releasing the buckle B1 or B2 on the upper portion 392 of the ski boot 390. This allows the pivot pin 308 to lower and the cam member 309 to rotate clockwise about pivot pin 312. The articulating stop member 311, which is biased away from the boot by torsion spring 328, thus rotates counterclockwise about pin 310 to release from engagement with the cam member 309. In the "walk" position, the upper and lower portions may rotate relative to each other without interference by the mechanism 300, thereby allowing the skier to walk more easily.

Figure 14A:
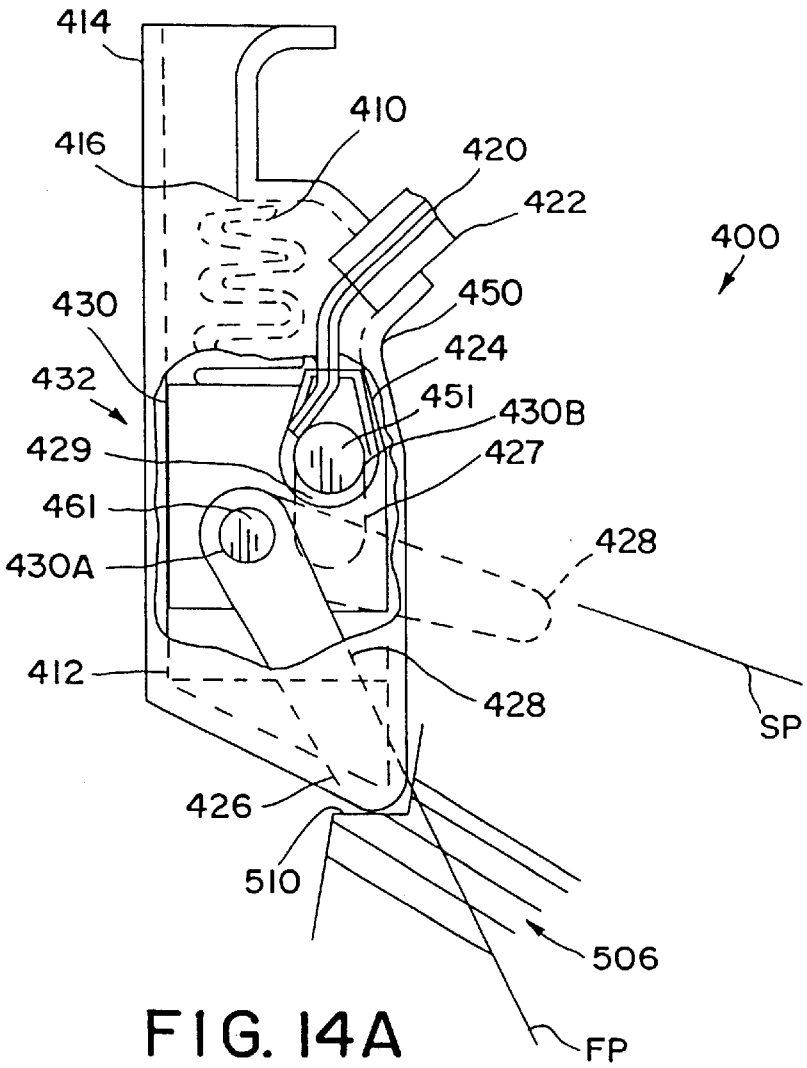
FIGS. 14 A–C illustrate another exemplary embodiment of a retention and release mechanism consistent with the present invention.
Figure 14B:
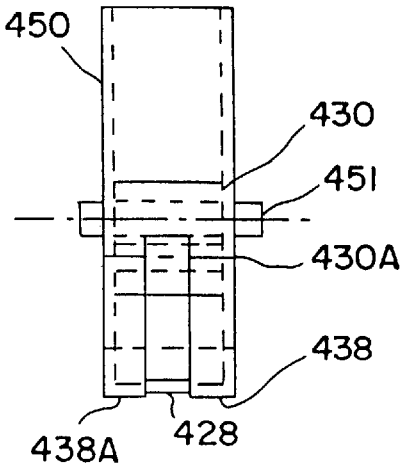
Figure 14C:
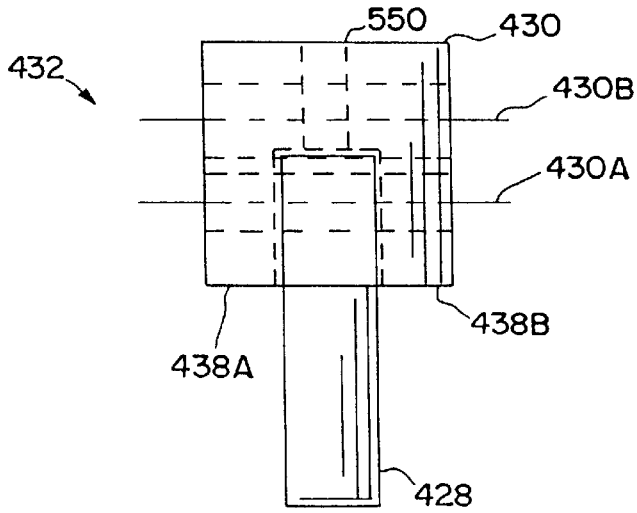

FIGS. 14A–C shows details of another retention and release mechanism 400 from several views. FIG. 14A shows a cut-away side view of the retention and release mechanism 400 securable to a ski boot 500, shown in FIGS. 15A–C. The ski boot has an upper portion 504 and a lower portion 506. The upper portion is pivotally coupled to the lower portion 506 on both sides of the ski boot 500 about a pivot pin 508. The retention and release mechanism 400 is pivotally coupled to the upper portion 504 of the ski boot 500 with a pin 451 and comes in abutment with the lower portion 506 of the ski boot 500.

The mechanism 400 includes a housing or first linkage 450 and a hinge carriage assembly or second linkage 432. The housing 450 has a first end and a second end. The first end 414 of the housing 450 is biased away from the upper portion 504 of the ski boot 500 by a compression spring 501. The second end 407 of the housing 450 abuts a protuberance 510 which is coupled to or integrally formed with the lower portion 506 of the ski boot 500 and extends towards the rear of the of the ski boot. The housing 450 has a channel 412 in which the hinge carriage assembly 432 travels between a first and a second position. Located on opposing sides of the channel are vertically oriented slots 427. Pin 451 extends out both sides of the hinge carriage assembly 432, through the slots 427 in the housing 450, and into the upper portion 504 of the ski boot 500. The mechanism 400 may further comprise a spring 410 for biasing the hinge carriage assembly 432 relative to a shelf portion 416 of the housing 450.

The hinge carriage assembly 432 includes a hinge carriage 430, a cam 428, and two pins 451 and 461. The hinge carriage 430, shown "U" shaped in the depicted embodiment, has a first hole 430A and a second hole 430B. Pivot pin 461 is located in hole 430A and rotatably couples the cam 428 between two down standing portions 438A and 438B of the hinge carriage. The cam is pivotable about pin 461 between a first position FP when the mechanism is in a "ski" position and a second position SP when the mechanism is in a "release position." In one embodiment, the hinge carriage 430 and the cam 428 are manufactured from a polyacetal material sold under the tradename DELRIN by E.I. du Pont de Nemours and company, and the housing may be metallic.

Figure 15A:
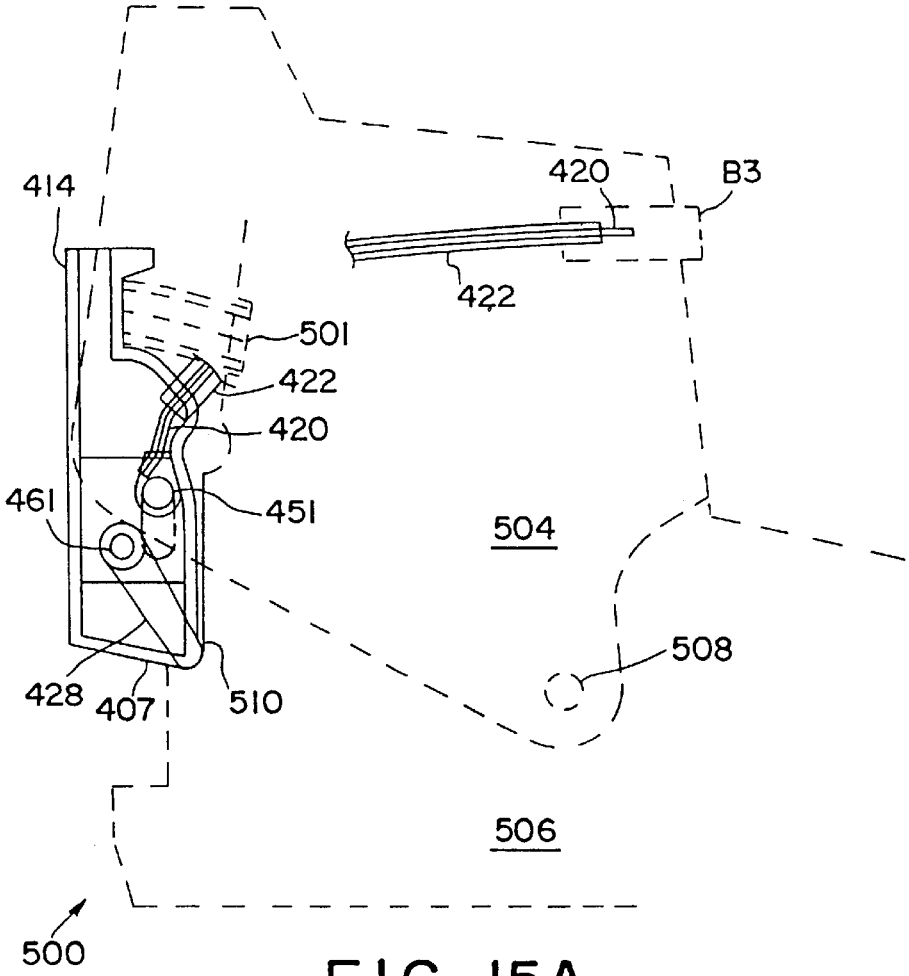
FIGS. 15 A–C illustrates the retention and release mechanism of FIG. 14 as the ski boot changes from the "ski" position to the "release" position.
Figure 15B:
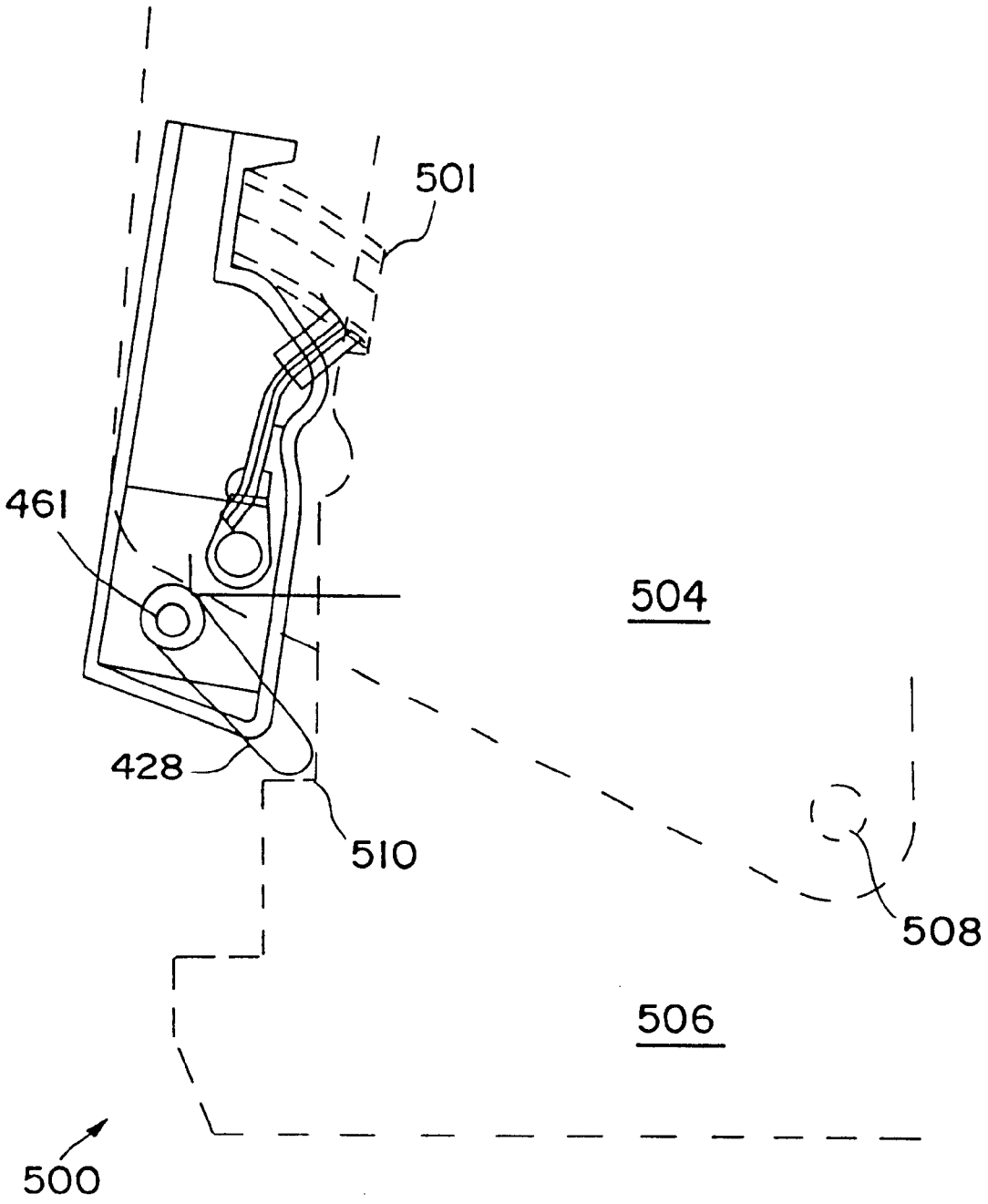

The pin 451 is located in hole 430B and is coupled to a first end of a cable 420 in a cable housing 422 with a cable hanger 424. The cable 420 extends upward through an opening 550 in the top of the hinge carriage 430. The second end of the cable 420 may be secured to a buckle B3 on the ski boot 500. As shown in FIG. 15A, when the buckle is closed, the cable 420 urges the hinge carriage assembly 432 towards the top of the channel 412.

The cable 420 prevents the hinge carriage assembly 432 from moving downward in the channel 412 unless a downward force is applied to pin 451 by the upper portion 504. In the "ski" position, the end 426 of cam 428 abuts the protuberance 510. In an alternative embodiment, the end 426 of the cam 428 may be spaced from the protuberance 510 in the ski position. In the "ski" position, the mechanism 400 provides stable orientation of the upper portion 504 of the ski boot to the lower portion 506 of the ski boot 500.

When the upper portion of the ski boot 504 is forced rearward by the skier's leg, a downward force is exerted on the mechanism 400 through pin 451. If the downward force exceeds a predetermined level, the hinge carriage 430 travels downward. Downward travel of the hinge carriage 430 causes engagement of the end 426 of cam member 428 with the protuberance 510. This forces the bottom of the housing away from the lower portion 506 and urges the housing 450 to rotate clockwise about the pivot pin 461 with the upper portion 414 tending to compress the compression spring 501. This can be seen in FIG. 15B.

Figure 15C:
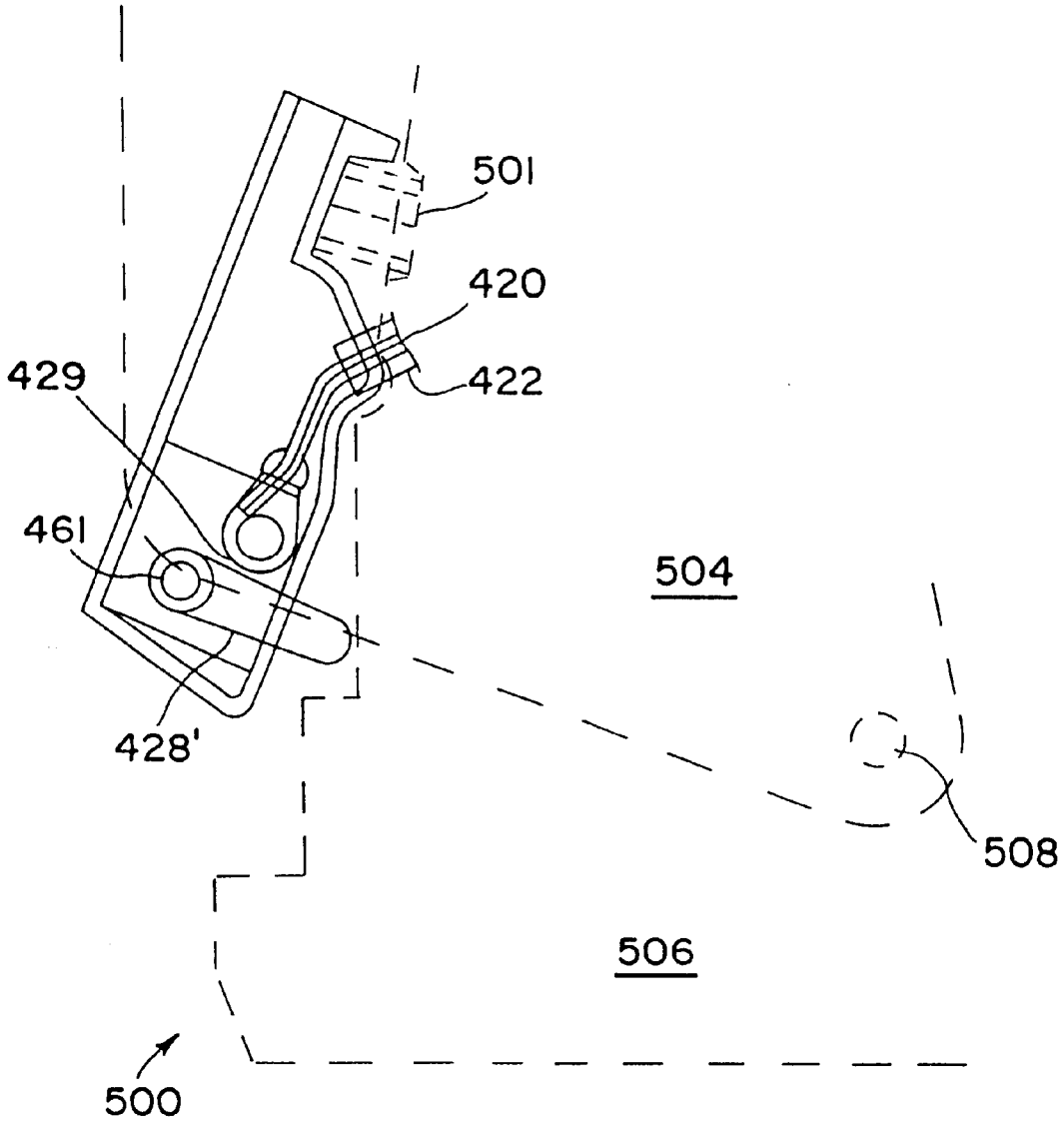

As the housing rotates, the cam member 428 rotates in a counterclockwise direction about the pin 461. The cam 428 will continue rotating about the protuberance 510 until the cam 428 abuts the cam stop element 429 of the hinge carriage 430, as shown in FIG. 14C and FIG 15C. In this "release" position, the upper portion 504 of the ski boot 500 is allowed to rotate relative to the lower portion 506 of the ski boot 500 about pivot pin 508.

The skier can manually enter a "walk" position by simply releasing the buckle B3. Without the cable 420 holding the hinge carriage assembly 432 in the position shown in FIG. 14A, the hinge carriage assembly 432 can move downward which allows the housing 450 to rotate.

Thus, according to the present invention there is provided a release and retention mechanism which, in a "ski" position, provides a stable relationship between a user and the upper and lower portions of a ski boot. When the user falls rearward, however, the mechanism releases to a "release" position at predetermined level of rearward force as established by the user through a tension adjustment assembly. In the "release" position the upper is allowed limited rearward rotation, thereby significantly reducing damaging forces on the knee joint and the likelihood of injury to the anterior cruciate ligament. When the user recovers control after the fall the user rotates the upper forwardly to return the mechanism to the "ski" position. Alternatively, if the skier cannot recover control after the mechanism is forced into the "release" position, the mechanism has the effect of shortening the effective moment arm of the ski tail to the knee, thereby increasing the likelihood that the skier will fall over the tail of the ski without damaging knee ligaments. The invention, therefore, functions in one aspect to absorb potentially injurious forces before the forces are sustained by the wearer's knee joint. The skier may also manually release the mechanism to a "walk" to more freely walk in the boot The embodiments described herein are but some of the several which utilize this invention and are set forth here by way of illustration but not of limitation. For example, a latch consistent with the invention may take a variety of forms, and may be permanently or releasably securable to the boot, either directly or through other elements such as a locking pin. Also, the orientation of a mechanism consistent with the invention relative to the upper and lower portions of the boot could be reversed. It is obvious that many other embodiments, which will be readily apparent to those skilled in the art, may be made without departing materially from the spirit and scope of the invention as defined in the appended claims.

What is claimed is:

1. A ski boot comprising:

a rigid first boot portion pivotally coupled to a rigid second boot portion; and a release and retention mechanism extending between said first portion and said second portion, said mechanism comprising:

a first linkage coupled to said first portion of said boot, and a second linkage coupled to said first linkage through a pin disposed in a slot in said first linkage, said slot being longitudinally disposed in said first linkage, a spring disposed between said first and second linkages for biasing said pin toward a bottom of said slot;

said pin being disposed in said slot for travel toward a top of said slot upon application of a predetermined rearward force to said first boot portion, said travel of said pin in said slot causing self-release of said first boot portion from a ski position relative to the second boot portion to a substantially vertical release position.

2. A ski boot according to claim 1, wherein a first end of said second linkage is coupled to said second end of said first linkage through said pin in said slot, and a second end of said second linkage is pivotally coupled to said second boot portion.

3. A ski boot comprising:

a rigid first boot portion pivotally coupled to a rigid second boot portion; and a release and retention mechanism extending between said first portion and said second portion, said mechanism comprising:

a first linkage coupled to said first portion of said boot, and a second linkage coupled to said first linkage through a pin disposed in a slot in said first linkage, said release and retention mechanism for changing the first boot portion from a ski position relative to the second boot portion to a substantially vertical release position upon travel of said pin in said slot due to application of a predetermined rearward force to said first boot portion, wherein a first end of said second linkage is coupled to said second end of said first linkage through said pin in said slot and wherein said mechanism further comprises a cam member and an articulating stop, said cam member having a first end pivotally coupled a second end of said second linkage and a second end coupled to said first portion of said boot by a cable, said articulating stop having a first end for engaging said cam member and a second end pivotally coupled to said second boot portion.

4. A ski boot according to claim 3, wherein said mechanism further comprises a dislodging element having a first end and a second end, said first end coupled to said first linkage, and said second end disposed adjacent said cam member for abutting said cam member upon imposition of said force.

5. A ski boot according to claim 1, wherein said first portion of said boot is an upper portion and said second portion of said boot is a lower portion.

6. A ski boot according to claim 1, wherein said spring establishes said predetermined level of rearward force.

7. A ski boot comprising:

a rigid first boot portion pivotally coupled to a rigid second boot portion; and a release and retention mechanism extending between said first portion and said second portion, said mechanism comprising:

a first linkage arm having a first end and a second end, said first end of said first linkage arm being pivotally coupled to said first portion of said boot, a second linkage arm having a first end and a second end, said first end of said second linkage arm being pivotally coupled to said second end of said first linkage arm at a pivot point, a cam member having a first end pivotally coupled to said second end of said second linkage arm and a second end coupled to said first portion of said boot by a cable, an articulating stop having a first end for engaging said cam member and a second end pivotally coupled to said second boot portion, and a dislodging element having a first end and a second end, said first end coupled to said first linkage arm, and said second end disposed adjacent said cam member, said release and retention mechanism for changing the first boot portion from a ski position relative to the second boot portion to a substantially vertical release position upon abutment of said dislodging element with said cam member due to application of a predetermined rearward force to said first boot portion.

8. A ski boot according to claim 7, wherein said first end of said second linkage arm is pivotally coupled to said second end of said first linkage arm through a pivot pin disposed in a slot in said first linkage arm.

9. A ski boot according to claim 7, wherein said first end of said dislodging element is disposed in a slot in said first linkage arm.

10. A ski boot according to claim 7, wherein said cable is coupled to a buckle on said first boot portion.

11. A ski boot according to claim 7, wherein said mechanism further comprises a spring disposed between said first linkage arm and said second linkage arm to establish a bias force to bias said first linkage arm against said second linkage arm, said bias force establishing said predetermined level of rearward force.

* * * * *